US009362037B2

(12) United States Patent
Piech et al.

(10) Patent No.: US 9,362,037 B2
(45) Date of Patent: Jun. 7, 2016

(54) MAGNETIC DEVICE FOR CONTROLLING DOOR MOVEMENT AND METHOD THEREOF

(75) Inventors: Zbigniew Piech, Cheshire, CT (US); Guohong Hu, New Britain, CT (US)

(73) Assignee: Otis Elevator Company, Farmington, CT (US)

( * ) Notice: Subject to any disclaimer, the term of this patent is extended or adjusted under 35 U.S.C. 154(b) by 675 days.

(21) Appl. No.: 13/503,472

(22) PCT Filed: Dec. 18, 2009

(86) PCT No.: PCT/US2009/068727

§ 371 (c)(1),
(2), (4) Date: Apr. 23, 2012

(87) PCT Pub. No.: WO2011/075142

PCT Pub. Date: Jun. 23, 2011

(65) Prior Publication Data

US 2012/0205505 A1 Aug. 16, 2012

(51) Int. Cl.

| | |
|---|---|
| ***E05C 17/56*** | (2006.01) |
| ***H01F 7/04*** | (2006.01) |
| ***B66B 13/12*** | (2006.01) |
| ***E05F 15/60*** | (2015.01) |
| *E05C 19/16* | (2006.01) |

(52) U.S. Cl.

CPC *H01F 7/04* (2013.01); *B66B 13/12* (2013.01); *E05F 15/60* (2015.01); *E05Y 2900/104* (2013.01); *Y10T 24/32* (2015.01); *Y10T 29/49826* (2015.01); *Y10T 292/11* (2015.04)

(58) Field of Classification Search

USPC ..... 292/251.5; 187/331 X, 335 X

See application file for complete search history.

(56) References Cited

U.S. PATENT DOCUMENTS

| | | | |
|---|---|---|---|
| 2,565,891 | A | 8/1951 | Sherman |
| 3,638,762 | A | 2/1972 | Johns |

(Continued)

FOREIGN PATENT DOCUMENTS

| | | | |
|---|---|---|---|
| CN | 101054878 | A | 10/2007 |
| EP | 0433830 | A1 | 6/1991 |

(Continued)

OTHER PUBLICATIONS

State Intellectual Property Office of People's Republic China, First Search Report for Application No. CN200980162970.9 dated Nov. 25, 2013.

(Continued)

*Primary Examiner* — Mark Williams
(74) *Attorney, Agent, or Firm* — Carlson, Gaskey & Olds

(57) ABSTRACT

An exemplary locking or coupling device includes a plurality of magnets each having a direction of magnetization. A plurality of pole shoe members are positioned between selected ones of the magnets. A moveable support supports some of the magnets and some of the pole shoe members. The moveable support is moveable to selectively change a relative orientation of the directions of magnetization. One relative orientation primarily directs a flow of magnetic flux between the magnets through the pole shoe members and the magnetic flux remains essentially in a plane containing the magnets and the pole shoe members. A second, different relative orientation primarily directs the flow of magnetic flux from the pole shoe members in a transverse direction away from the plane.

17 Claims, 7 Drawing Sheets

(56) References Cited

U.S. PATENT DOCUMENTS

| | | | | |
|---|---|---|---|---|
| 4,009,767 | A | 3/1977 | Stadigh | |
| 4,148,377 | A | 4/1979 | Foelix et al. | |
| 4,471,856 | A | 9/1984 | Magee | |
| 5,174,417 | A | 12/1992 | Pilsbury | |
| 5,175,455 | A | 12/1992 | Penicaut | |
| 5,487,449 | A | 1/1996 | Barrett et al. | |
| 5,661,350 | A | 8/1997 | Lucidarme et al. | |
| 5,736,693 | A | 4/1998 | Piech et al. | |
| 6,070,700 | A | 6/2000 | Nagel | |
| 6,590,355 | B1 * | 7/2003 | Kikuchi et al. | 310/12.06 |
| 7,626,348 | B2 * | 12/2009 | Cartier et al. | 318/135 |
| 2002/0050426 | A1 | 5/2002 | Yamamoto et al. | |
| 2005/0023841 | A1 | 2/2005 | Chen | |
| 2008/0271958 | A1 | 11/2008 | Lelic et al. | |
| 2008/0271959 | A1 | 11/2008 | Gieras et al. | |

FOREIGN PATENT DOCUMENTS

| | | | |
|---|---|---|---|
| JP | 9242418 | A | 9/1997 |
| WO | 0236917 | A1 | 5/2002 |

OTHER PUBLICATIONS

International Search Report and Written Opinion of the International Searching Authority for International application No. PCT/US2009/068727 dated Sep. 9, 2010.

International Preliminary Report on Patentability for International application No. PCT/US2009/068727 dated Jun. 28, 2012.

* cited by examiner

MAGNETIC DEVICE FOR CONTROLLING DOOR MOVEMENT AND METHOD THEREOF

BACKGROUND

There are various situations in which controlling door movement is important. For example, it is useful to lock doors to prevent them from being opened except for under authorized conditions. There are a variety of known door locking mechanisms. Conventional, mechanical locks typically require a key to manipulate the lock for purposes of opening the door. More recently, electronic locks have been utilized in a variety of situations to control whether a door is locked without requiring a mechanical key.

Elevator systems also require controlled door movement. Elevator car doors and hoistway doors move together when an elevator car is at a landing to permit passage between an elevator car and the lobby. Many arrangements for coupling elevator car doors and hoistway doors together are mechanical in nature. Mechanical door couplers suffer from the drawback of requiring specific alignments that tend to complicate the installation process. Additionally, the mechanical components tend to wear over time and require maintenance.

Other elevator door coupler arrangements have been proposed that include magnets in place of or in addition to mechanical coupling components. Examples are shown in U.S. Pat. Nos. 5,487,449 and 3,638,762. The use of magnets in an elevator door coupling arrangement may overcome some of the drawbacks associated with purely mechanical coupling arrangements.

SUMMARY

An exemplary locking or coupling device includes a plurality of magnets each having a direction of magnetization. A plurality of pole shoe members are positioned between selected ones of the magnets. A moveable support supports some of the magnets and some of the pole shoe members. The moveable support is moveable to selectively change a relative orientation of the directions of magnetization. One relative orientation primarily directs a flow of magnetic flux between the magnets through the pole shoe members and the magnetic flux remains essentially in a plane containing the magnets and the pole shoe members. A second, different relative orientation primarily directs the flow of magnetic flux from the pole shoe members in a transverse direction away from the plane.

An exemplary method of controlling a magnetic coupling includes selectively arranging a direction of magnetization of a plurality of magnets in a first relative orientation to primarily direct a flow of magnetic flux between the magnets through pole she members between the magnets such that the magnetic flux remains essentially in a plane containing the magnets and the pole shoe members. The method includes selectively arranging the direction of magnetization in a second, different relative orientation to primarily direct the flow of magnetic flux from the pole shoe members in a transverse direction away from the plane.

The various features and advantages of disclosed examples will become apparent to those skilled in the art from the following detailed description.

The drawings that accompany the detailed description can be briefly described as follows.

DETAILED DESCRIPTION

Figure 1:
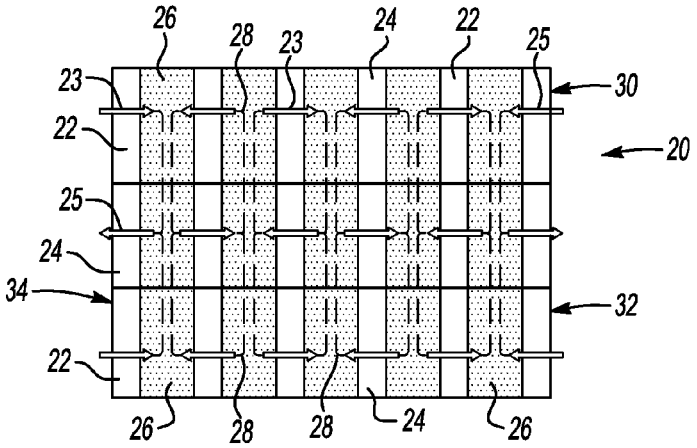
FIG. 1 schematically illustrates an example device designed according to an embodiment of this invention.

FIG. 1 schematically shows selected portions of an example device 20 that is useful for locking or coupling doors, for example. A plurality of magnets 22, 24 each have a direction of magnetization 23, 25. The directions of magnetization are selectively arranged into different relative orientations to control whether the device 20 establishes a magnetic coupling with an object near the device 20.

The illustrated example includes a plurality of first magnets 22. The direction of magnetization of the first magnets 22 is schematically shown by the arrows 23. The direction of magnetization 23 depends on an alignment of the north and south poles of each magnet, for example. A plurality of second magnets 24 each have a direction of magnetization schematically shown by the arrows 25. As can be appreciated from the drawing, the directions of magnetization 23 and 25 are different from each other. In this example, they are directly opposite to each other.

The example of FIG. 1 includes a plurality of magnetic pole shoe members 26 positioned between adjacent magnets. The pole shoe members 26 provide a desired amount of spacing between the magnets and facilitate controlling a primary direction of magnetic flux 28.

The directions of magnetization are in a first relative orientation in FIG. 1. That relative orientation primarily directs a flow of the magnetic flux 28 between the magnets 22 and 24 and through the pole shoe members 26. The magnetic flux 28 stays mostly within a plane containing the magnets 22, 24 and the pole shoe members 26. There may be some leakage flux in another direction but the primary flux path is as schematically shown in FIG. 1. The direction of magnetic flux 28 in FIG. 1 allows for controlling the device 20 to prevent it from establishing a magnetic coupling with an object near the device 20.

Figure 2:
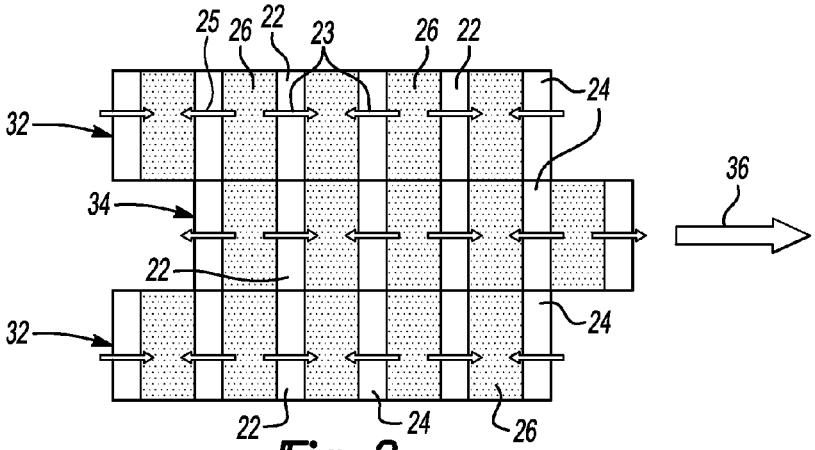
FIG. 2 schematically illustrates the example of FIG. 1 in a different operating condition.

FIG. 2 shows the directions of magnetization in a second, different relative orientation. In FIG. 2, the relative orientation primarily directs the flow of magnetic flux from the magnets 22, 24 toward the pole shoe members 26 and out of the pole shoe members 26 in a direction transverse to the plane within which the flux 28 primarily remains in FIG. 1. In one example, the magnetic flux 28 primarily flows out of the page (according to the drawing) when the directions of magnetization are in the second relative orientation of FIG. 2. Having the magnetic flux 28 flowing out of the pole shoe members 26 allows the device 20 to establish a magnetic coupling with a nearby object.

The example device 20 is configured to allow for selectively changing the relative orientations by moving at least some of the magnets 22, 24 relative to others of the magnets 22, 24. For purposes of discussion, the first magnets 22 are considered collectively as a plurality because they all have the same direction of magnetization 23. Similarly, the second magnets 24 are considered a plurality because they all have the same direction of magnetization 25. The first magnets 22 need not be different in structure or composition from the second magnets 24. Rather, the directions of magnetization 23, 25 distinguish one set from the other.

The example of FIG. 1 includes some of the first magnets 22 in a first row 30, some more of the first magnets 22 in a second row 32 and others of the first magnets 22 in a third row 34. In this example, the third row 34 is between the first row 30 and second row 32. Some of the second magnets 24 are in each of the first row 30 and the second row 32. Others of the second magnets 24 are in the third row 34.

Figure 3:
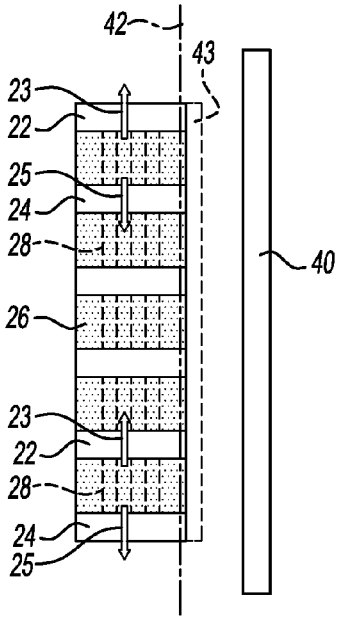
FIG. 3 schematically illustrates a feature of the example of FIG. 1.

The device 20 as shown in FIG. 1 is in an inactive condition in which the device 20 does not tend to establish a magnetic coupling with objects near the device 20. The arrangement of FIG. 1 includes the directions of magnetization 23, 25 oriented relative to each other to limit an amount of magnetic flux that would emanate from the magnets 22 and 24 in a coupling direction. Instead, that relative orientation primarily directs the flow of the magnetic flux 28 between the magnets 22 and 24 and through the pole shoe members 26. The magnetic flux 28 stays mostly within a plane containing the magnets 22, 24 and the pole shoe members 26 as can be appreciated in FIG. 3, for example.

In this relative orientation, the second magnets 24 in the third row 34 are directly aligned with the first magnets 22 in the first row 30 and the second row 32. Similarly, the first magnets 22 in the third row 34 are directly aligned with second magnets 24 in the first row 30 and the second row 32. The direction of direct magnet alignment is perpendicular to the directions of magnetization 23 and 25. Having the directions of magnetization 23 and 25 arranged in this orientation limits an amount of magnetic flux that would emanate in a direction into or out of the page in FIG. 1 and to the right or left in FIG. 2 (according to the drawings). The magnetic flux will be primarily within a plane 42 shown in FIG. 3 or a plane of the page in FIG. 1 when the directions of magnetization are in the illustrated, inactive relative orientation.

FIG. 2 shows a second, different position of the magnets relative to each other and a different relative orientation of the directions of magnetization 23, 25. The third row 34 of magnets has moved as schematically shown by the arrow 36. The position of FIG. 2 is considered an active position because it allows for magnetic flux to emanate from the magnetic pole shoe members 26 in a coupling direction toward a coupler member 40 that is to be magnetically coupled to the device 20 as shown in FIG. 4.

As can be appreciated from FIG. 2, the directions of magnetization 23 and 25 are in the second relative orientation because the first magnets 22 are directly aligned with each other along a direction perpendicular to the direction of magnetization 23. Similarly, the second magnets 24 are directly aligned with each other along a direction perpendicular to the direction of magnetization 25. When the directions of magnetization 23 and 25 are in the relative orientation of FIGS. 2 and 4, the device is situated for establishing a magnetic coupling between the device 20 and the coupler member 40, which can comprise a ferromagnetic material for example.

Figure 4:
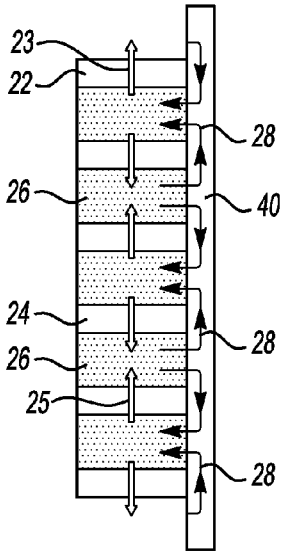
FIG. 4 schematically illustrates a feature of the example of FIG. 2.

FIG. 4 shows the arrangement when the magnets are in the active position of FIG. 2. In this condition, magnetic flux 28 primarily is directed from the pole shoe members 26 in the coupling direction toward the coupler member 40, through the coupler member 40 and back into an adjacent pole shoe member 26. With the directions of magnetization in the second relative orientation, the coupler member 40 is magnetically coupled with the device 20.

The example arrangement provides a passive magnetic device that is selectively controlled to be active or inactive for purposes of establishing a magnetic coupling. The magnets 22 and 24 are permanent magnets in this example. There is no requirement to use electromagnets and no power supply needed. This provides the advantage of utilizing permanent magnets rather than more expensive electromagnets and eliminating any requirement for a power supply. At the same time, however, the device 20 is capable of being selectively utilized to establish a magnetic coupling by controlling the relative orientation of the directions of magnetization 23, 25 of the magnets 22, 24.

Figure 5:
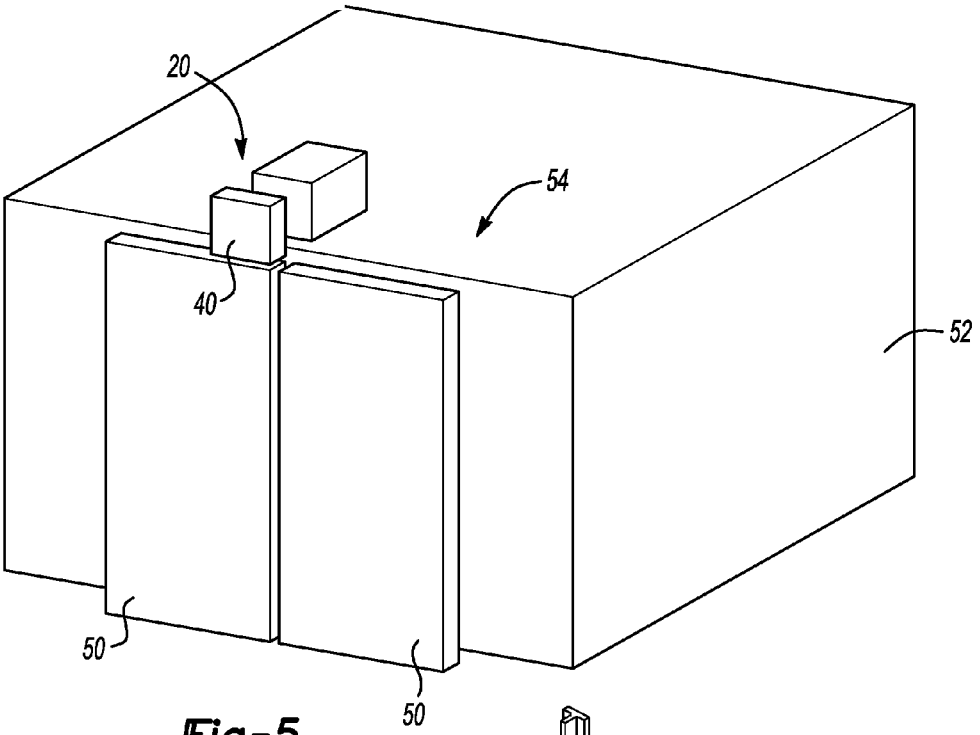
FIG. 5 illustrates an example door lock arrangement including a locking device having features similar to the example of FIGS. 1 and 2.

FIG. 5 shows one example use of such a device. In this example, the device 20 is part of a door lock used to control whether doors 50 can be opened. The doors 50 control whether there is access to an area 52, which may be a room, building or an elevator car for example. In this example, the coupler member 40 is associated with at least one of the doors 50 and the device 20, including the magnets 22 and 24, is situated relative to a stationary structure 54 at the threshold to the area 52. When the doors 50 are in a closed position, the position of the magnets 22 and 24 is controlled to place the device 20 into the active position to establish a magnetic coupling with the coupler member 40 such as, for example, in the manner shown in the example embodiment depicted in FIGS. 2 and 4. By placing the device 20 in the active position, the coupler member 40 is prevented from moving away from the device 20, which prevents the doors 50 from being opened. When it is desirable to open the doors, the directions of magnetization 23, 25 are switched into the first relative orientation corresponding to the inactive condition of the device 20 so that there is no magnetic coupling with the coupler member 40 such as, for example, in the manner shown in the example embodiment depicted in FIGS. 1 and 3. When the device 20 is in the inactive condition, the doors are free to move into an open position.

Figure 6:
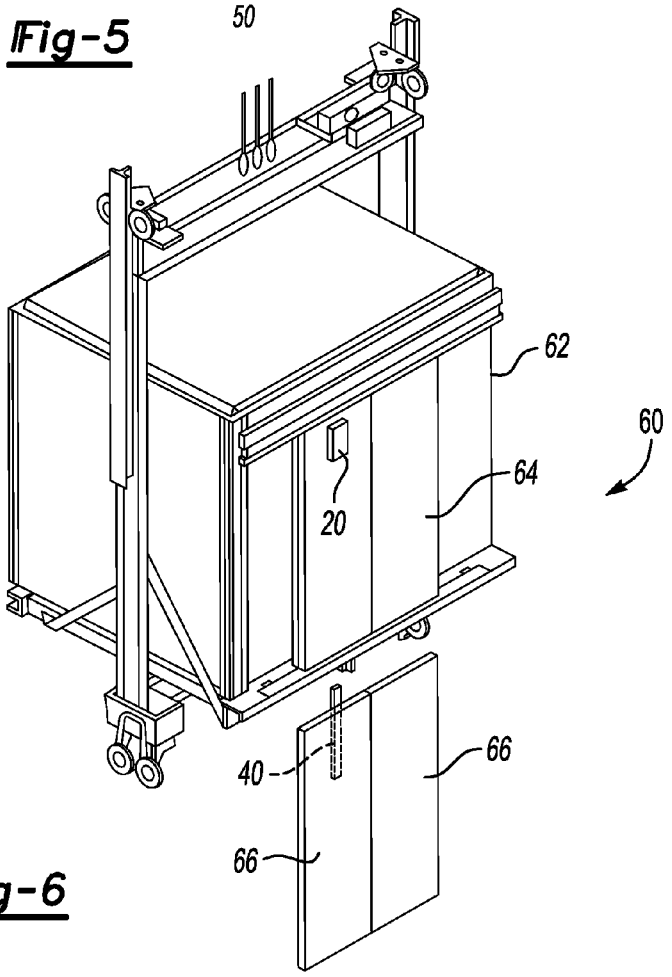
FIG. 6 illustrates selected portions of an example elevator system including a door coupling device having features similar to those of the example of FIGS. 1 and 2.

FIG. 6 shows another example use of the example device 20. Selected portions of an elevator system 60 are shown including an elevator car 62 having elevator car doors 64. The device 20 is associated with the elevator car door 64. Hoistway doors 66 are positioned at a landing along the hoistway within which the elevator car 62 moves. The coupler member 40, which comprises a coupler vane in this example, is associated with the hoistway doors 66. In this example, the device 20 provides for coupling the elevator car doors 64 with the hoistway doors 66 so that they move together between open and closed positions.

Figure 7:
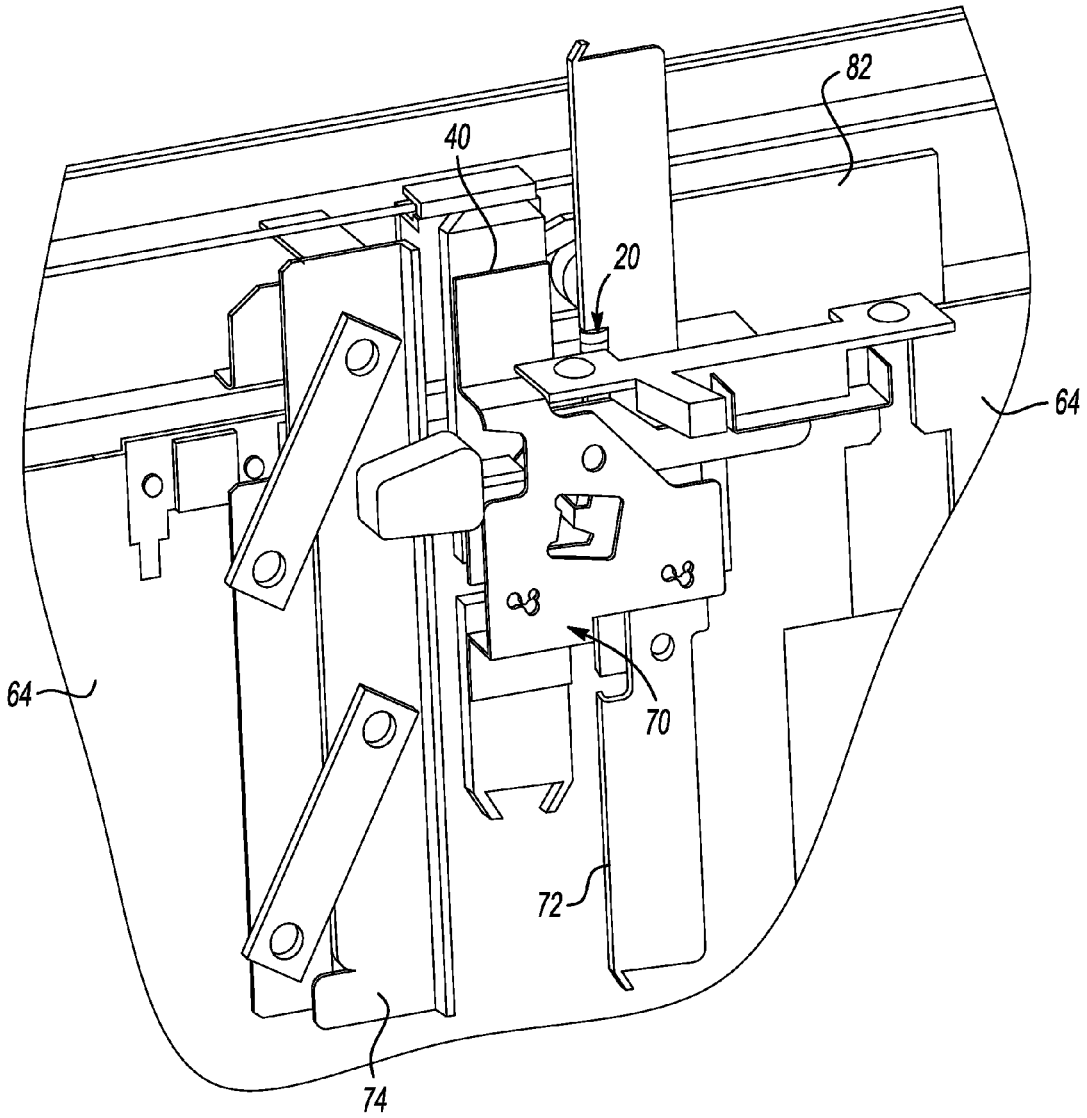
FIG. 7 is a diagrammatic illustration of an example elevator door coupler device.

FIG. 7 shows one example arrangement including a door interlock 70 associated with the coupler member 40, which is situated for movement with a hoistway door 66 (not shown in FIG. 7). The interlock 70 controls whether the hoistway doors 66 are locked or can be opened and operates in a known manner in one example.

The device 20 is supported with a coupler vane 72 for movement with the elevator car doors 64. A deterrent 74 that operates in a known manner is also shown in FIG. 7.

Figure 8:
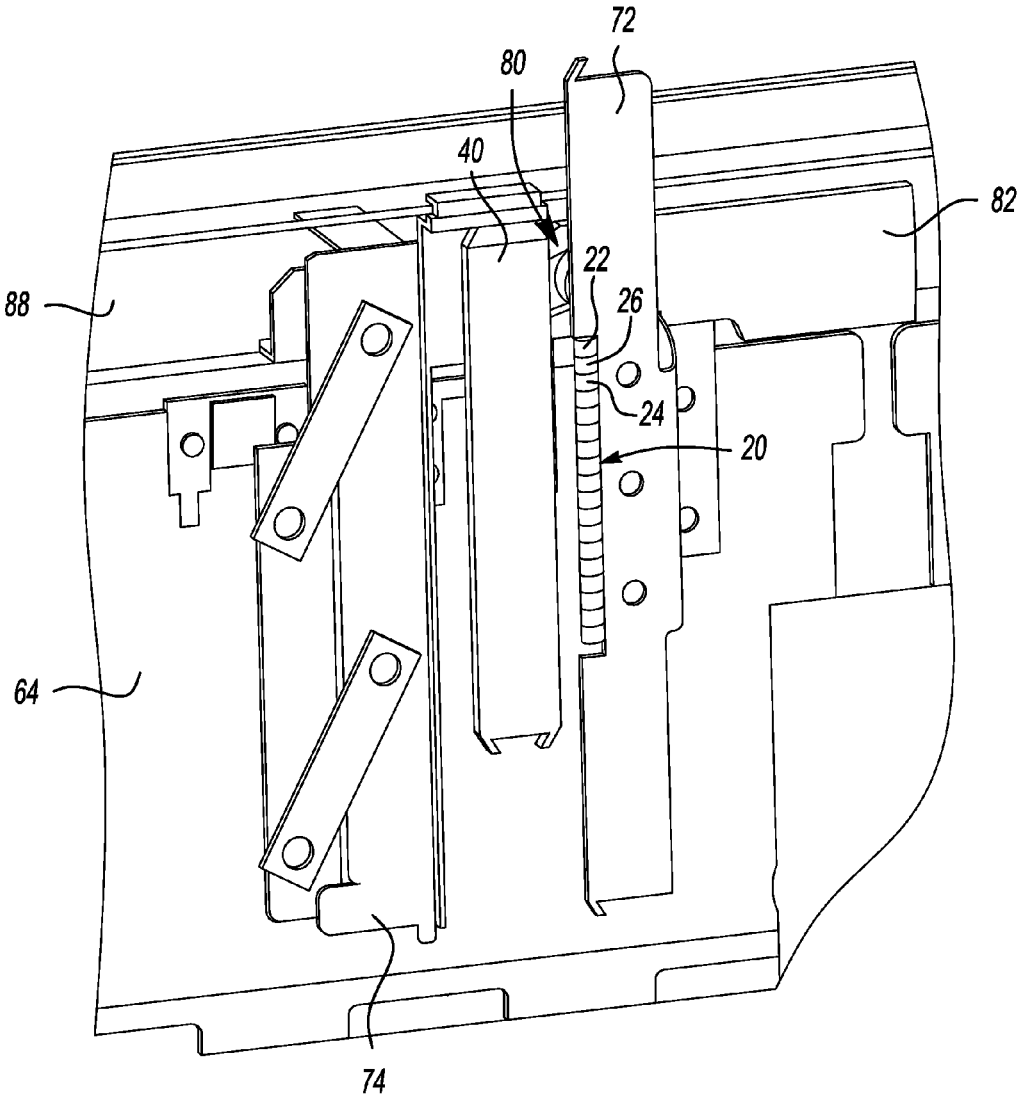
FIG. 8 shows selected features of the example of FIG. 7.

FIG. 8 shows the same arrangement with the interlock device 70 removed so that the relationship between the coupler member 40 and the device 20 can be better appreciated. As the elevator car doors 64 move from the closed position shown in FIGS. 7 and 8 toward an open position, the device 20 approaches the coupler member 40 that is supported for movement with hoistway doors 66.

As the elevator car 62 is moving through the hoistway, the device 20 is kept in the inactive condition so that there is no tendency to establish any magnetic coupling between the device 20 and the coupler member 40 of any hoistway doors 66. When the elevator car 62 has stopped at a landing and the car doors 64 begin to open, the device 20 moves into the active condition to establish a magnetic coupling between the device 20 and the coupler member 40.

As can be appreciated from the drawing, in this example as the elevator car door 64 moves to the left, the vane member 72 and the device 20 will tend to push the coupler member 40 to the left, also. As the door 64 moves back toward a closed position (e.g., to right in the drawing), the magnetic coupling between the device 20 and the coupler member 40 ensures that they move together. This magnetic coupling ensures that the corresponding hoistway door 66 (FIG. 6) moves with the elevator car door 64 back to the closed position.

Figure 9:
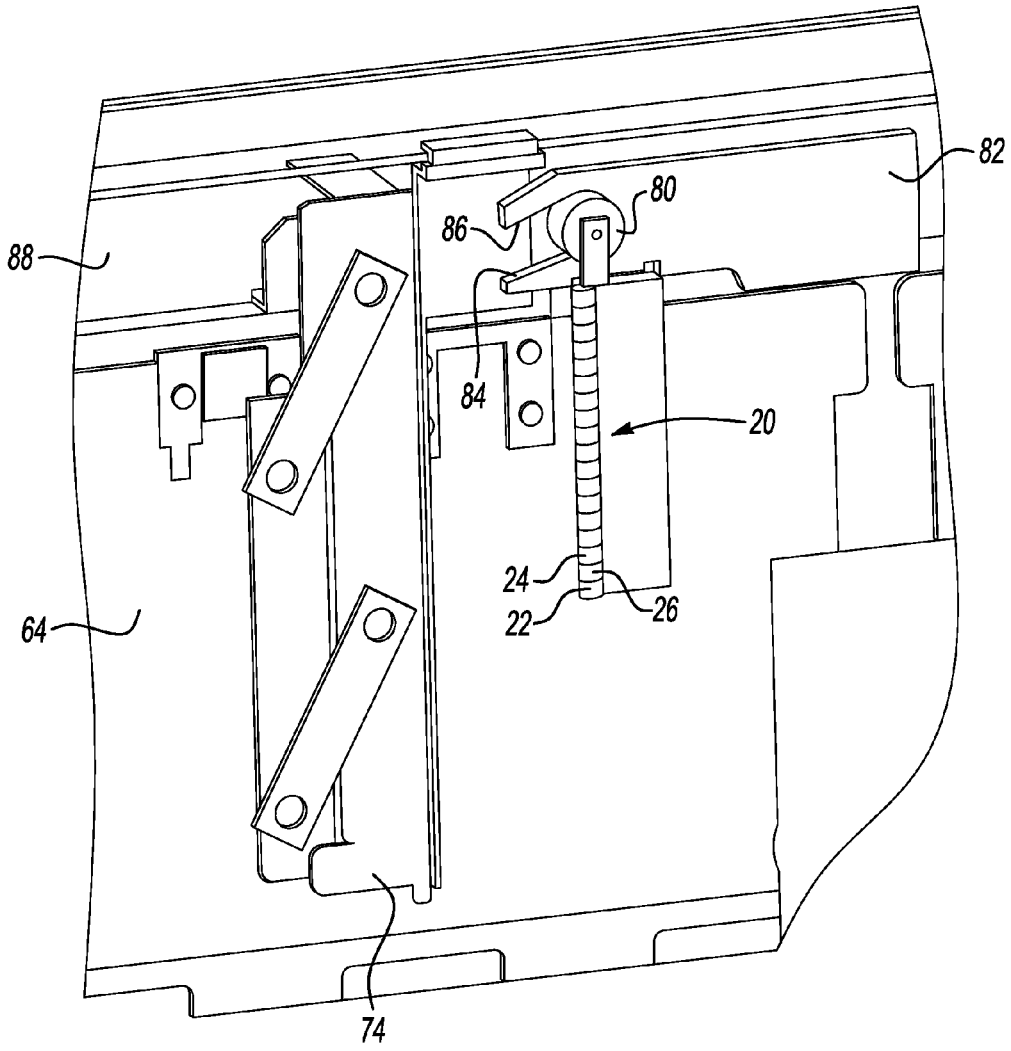
FIG. 9 shows more selected features of the example of FIG. 7.

FIG. 9 shows selected portions of the arrangement of FIG. 7. In particular, the door interlock 70, the coupler member 40 and the vane member 72 have all been removed from the illustration. The device 20 includes a follower 80, which comprises a roller in this example. The follower 80 is selectively moved by an activator 82 for purposes of moving some of the magnets 22 and 24 relative to others of the magnets 22 and 24 to change the relative orientation of the directions of magnetization to switch the device 20 between the active and inactive conditions. In this example, the activator 82 comprises a bracket having inclined surfaces 84 and 86. As the car door 64 moves out of the closed position the follower roller 80 will roll along the surface 86, which urges the follower 80 downward. In this example, the activator 82 comprises a bracket that remains fixed relative to a header 88 associated with the elevator car 62.

As can be appreciated from the drawing, as the elevator car door 64 moves to the left from the fully closed position of FIG. 9, the follower 80 tends to move downward along the inclined surface 86. Such downward movement changes the relative orientations of the directions of magnetization 23 and 25 of the first and second magnets 22 and 24 to place the device 20 into the active condition for magnetically coupling the device 20 with the coupler member 40. As the elevator car door 64 returns to the fully closed position, the follower 80 moves upward along the inclined surface 84, which moves some of the magnets 22, 24 relative to other of the magnets 22, 24 to put the directions of magnetization into the first relative orientation corresponding to the inactive condition in which magnetic flux in a coupling direction toward the coupler member 40 is limited. In other words, movement of the follower 80 along the inclined surface 84 as the car door 64 moves to a fully closed position changes the device 20 from the active condition to the inactive condition to release any magnetic coupling between the device 20 and the coupler member 40.

Figure 10:
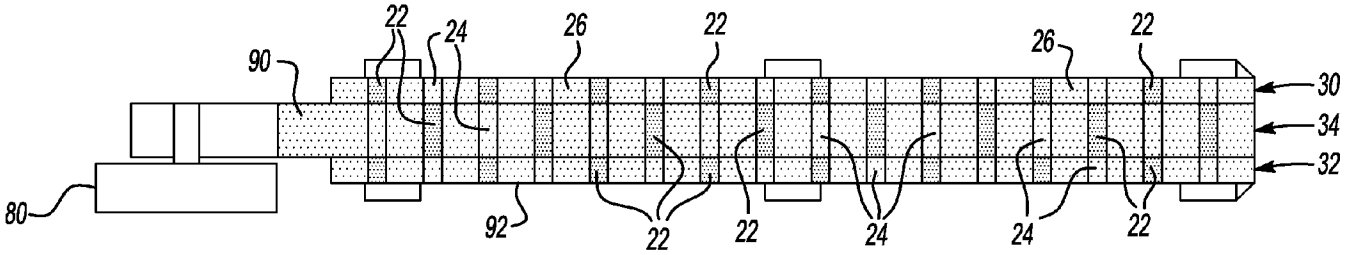
FIG. 10 is an elevational view of an example device that is useful for locking a door or coupling doors together such as the example doors of FIGS. 6 and 7.
Figure 11:
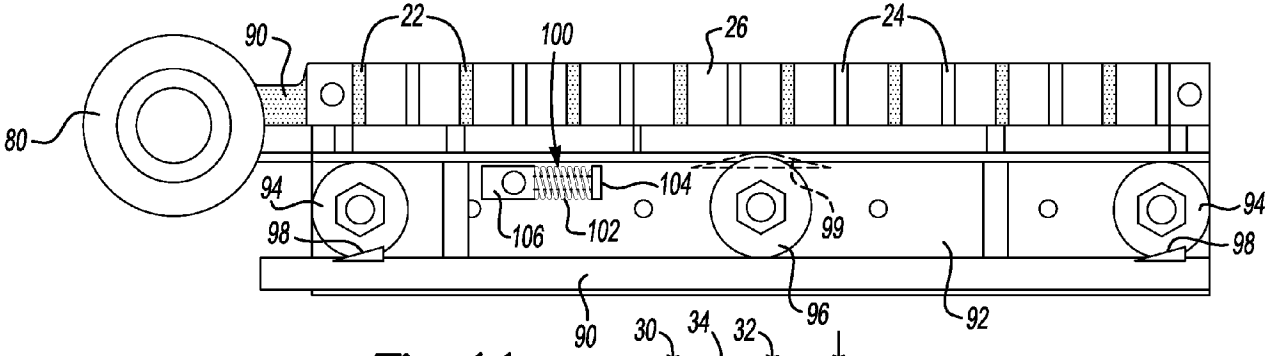
FIG. 11 is a side elevational view of the example of FIG. 10.
Figure 12:
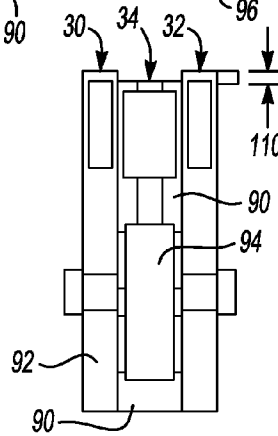
FIG. 12 is an end view of the examples shown in FIGS. 10 and 11.

Referring to FIGS. 10-12, one example arrangement of the coupler device 20 includes a moveable support 90 that supports some of the first magnets 22 and some of the second magnets 24. The moveable support 90 supports the magnets corresponding to the third row 34 as shown in FIGS. 1 and 2, for example. This example includes three rows, 30, 32 and 34 of magnets arranged so that the magnets supported by the moveable support 90 are positioned between the other two rows of magnets. This example device also includes a base 92 that holds the first row 30 and second row 32 of magnets 22 and 24. The base 92 remains fixed relative to the elevator car door 64. The moveable support 90 moves relative to the base 92.

A plurality of rollers 94 and 96 are provided to facilitate relative movement between the moveable support 90 and the base 92. In this example, inclined surfaces 98 are positioned to interact with the rollers 94 and an inclined surface 99 is positioned to interact with the roller 96. The rollers 94 contact a lower portion (according to the drawing) of the moveable support 90 and the roller 96 contacts an upper portion (according to the drawing) of the moveable support 90. When the device is in the inactive condition show in FIGS. 10-12, the inclined surfaces 98 and 99 tend to urge the moveable support 90 and the magnets 22 and 24 in the third row 34 away from the coupling direction or slightly downward (according to the drawings). When the device is in the inactive condition in this example, there is a variation in position between the outer edges of the magnets 22 and 24 in the coupling direction. This is shown as spacing 110 in FIG. 12. The magnets 22 and 24 in the third row 34 are slightly recessed compared to those in the first rows 30 and 32. This relative position of the magnets in the different rows further minimizes any tendency for any leakage flux in the coupling direction to have any magnetic coupling effect in the coupling direction. The relatively recessed position of the magnets 22 and 24 in the third row 34 increases a gap between those magnets and any nearby coupler member 40, which effectively reduces or eliminates any magnetic coupling effect of any leakage flux in the coupling direction.

Figure 13:
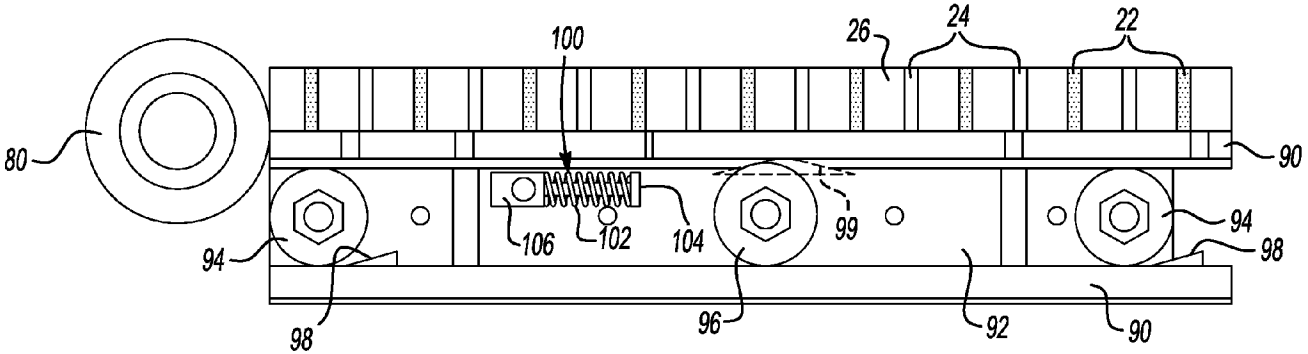
FIG. 13 is a view similar to FIG. 11 showing the device in another operating condition.
Figure 14:
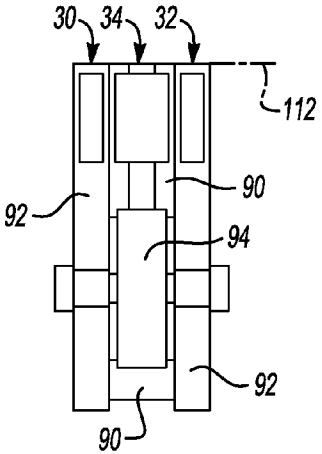
FIG. 14 is an end view similar to that shown in FIG. 12 but showing the device in an operating condition consistent with what is shown in FIG. 13.

FIGS. 13 and 14 show the same device in the active condition. The follower or roller 80 and the moveable support 90 have moved to the right relative to the stationary base 92 (according to the drawing) by comparing FIGS. 13 and 11, for example. In this position, the directions of magnetization 23 and 25 are in the second relative orientation. In this orientation the first magnets 22 are directly aligned with each other and the second magnets 24 are directly aligned with each other (as shown in FIG. 2, for example). The relative movement between the moveable support 90 and the base 92 includes movement of the rollers 94 along the inclined surfaces 98 and movement of the roller 96 along the inclined surface 99. Such relative movement urges the magnets 22, 24 and pole shoe members 26 in the third row 34 to no longer be in a recessed position but, instead, to be aligned with the magnets in the rows 30 and 32 such that the outer edges of the magnets in the coupling direction are all coplanar and aligned as shown at 112 in FIG. 14.

Some examples will include a biasing member 100 such as the spring shown in FIGS. 11 and 13. The example biasing member 100 biases the moveable support 90 and associated magnets and pole shoe members into the position corresponding to the active condition of the device 20. In this example, the biasing member 100 comprises a coil spring 102 that acts against a first surface 104 that moves with the moveable support 90 and a second surface 106 that remains fixed relative to the base 92. The bias of the spring 102 tends to urge the magnets and pole shoe members into the position corresponding to the second relative orientation of the directions of magnetization (i.e., the active condition of the device 20). When the base 92 is fixed relative to another surface (such as an elevator car door 64), movement of the roller 80 along the inclined surfaces 84 as the car door 64 approaches a fully closed position will overcome the bias of the spring 102 to move the device 20 into the inactive condition as the roller 80 is urged from the position shown in FIG. 13 to the position shown in FIG. 11 (e.g., to the left according to the drawings). Such movement can also change the relative orientation of the edges of the magnets and pole shoe members in the coupling direction as can be appreciated from FIGS. 12 and 14.

In another example, a spring is secured at one end to the moveable support 90 and at another end to the vane member 72 so that a tension of the spring biases the magnets and pole shoe members into a position corresponding to an active condition. Examples that include an activator 82 do not need to include a biasing member such as a spring. The interaction between the follower 80 and the activator 82 is sufficient to control the relative orientations of the magnets to keep the device in the desired condition. The illustrated example shows the biasing member 100 as a supplemental feature.

Utilizing permanent magnets for purposes of locking or coupling doors using a device as shown in the illustrated examples allows for eliminating mechanical locking or coupling components that may tend to wear over time. Additionally, the use of the permanent magnets and selectively controlling the relative orientations of their directions of magnetization allows for selectively activating the device to establish a magnetic coupling without requiring any power supply. The example devices are passive and selectively controllable. Being able to utilize a magnetic coupling and an elevator door coupling arrangement allows for reducing tolerances during installation and reduces wear over time, both of which provide for installation and maintenance cost savings.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A locking or coupling device, comprising:

a first set and a second set of:

(1) a plurality of magnets, each magnet of the plurality of magnets of each set having a direction of magnetization;

(2) a plurality of pole shoe members, for each set, each pole shoe member of the plurality of pole shoe members is located adjacently between selected ones of the magnets in an alternating fashion, wherein the first set and second set are positioned adjacent each other; and a moveable support supporting the first set of the plurality of magnets and plurality of pole shoe members, the moveable support being moveable relative to the second set of the plurality magnets and plurality of pole shoe members to selectively change a relative orientation of the directions of magnetization between;

(i) a first relative orientation wherein a flow of magnetic flux is primarily directed between the magnets through the pole shoe members and the magnetic flux remains essentially in a plane containing the magnets and the pole shoe members, so as to generally not provide magnetic coupling of objects outside the plane, and (ii) a second, different relative orientation wherein the flow of magnetic flux is primarily directed from the pole shoe members in a transverse direction away from the plane, thereby providing magnetic coupling of objects outside the plane.

2. The device of claim 1, wherein the first relative orientation corresponds to an inactive condition of the device wherein the device does not establish a magnetic coupling with objects outside the plane and the second relative orientation corresponds to an active condition of the device wherein the device is configured to establish a magnetic coupling with a nearby object.

3. The device of claim 1, comprising a coupler member positioned near the magnets and the pole shoe members outside of the plane such that the magnetic flux directed in the transverse direction is operative to magnetically couple the coupler member to the device.

4. The device of claim 1, wherein the plurality of magnets includes a plurality of first magnets each having a first direction of magnetization;

a plurality of second magnets each having a second, different direction of magnetization; and some of the first magnets and some of the second magnets are supported on the moveable support to be moveable relative to others of the first magnets and second magnets.

5. The device of claim 4, comprising a base that is configured to support others of the first magnets and the second magnets in at least one row, and wherein the moveable support is moveable relative to the base and the moveable support supports the some of the first magnets and the some of the second magnets in another row.

6. The device of claim 5, wherein the first magnets supported on the base alternate with the second magnets supported on the base, the first magnets supported on the moveable support alternate with the second magnets supported on the moveable support, and one of the pole shoe members is between each magnet and an adjacent one of the magnets supported on the moveable support and on the base.

7. The device of claim 5, wherein the base is configured to support the others of the first magnets and second magnets in two rows and the moveable support is received at least partially between the two rows.

8. The device of claim 7, wherein an inactive condition of the device includes:

one of the first magnets in each of the two rows directly aligned with one of the second magnets supported on the moveable support and one of the second magnets in each of the two rows directly aligned with one of the first magnets supported on the moveable support; and an active position of the device includes:

one of the first magnets in each of the two rows directly aligned with one of the first magnets supported on the moveable support and one of the second magnets in each of the two rows directly aligned with one of the second magnets supported on the moveable support.

9. The device of claim 8, wherein the inactive condition includes the first magnets directly aligned with the second magnets in a direction perpendicular to the directions of magnetization and the active condition includes the first magnets directly aligned with each other in a direction perpendicular to the first direction of magnetization and the second magnets directly aligned with each other in a direction perpendicular to the second direction of magnetization.

10. The device of claim 1, wherein the moveable support is moveable relative to others of the magnets in:

(i) a first moving direction for changing between the first and second relative orientations and (ii) a second, different moving direction transverse to the plane.

11. The device of claim 10, comprising a base supporting others of the magnets;

a plurality of rollers supported on one of the moveable support or the base to facilitate relative movement between the base and the moveable support; and a corresponding plurality of inclined surfaces on the other of the base or the moveable support, the inclined surfaces being engaged by the rollers during movement of the moveable support in the first moving direction to cause the movement in the second moving direction.

12. The device of claim 1, wherein the device comprises a door lock associated with a door, a magnetic coupling resulting from the directions of magnetization being in the second relative orientation resisting movement of the door from a closed position into an open position.

13. The device of claim 1, wherein the device comprises an elevator door coupler that selectively couples an elevator car door to a hoistway door when the directions of magnetization are in the second relative orientation.

14. The device of claim 13, comprising an activator that moves the moveable support into a position corresponding to the second relative orientation when the elevator car door moves from a closed position and moves the moveable support into a position corresponding to the first relative orientation when the elevator car door moves toward the closed position.

15. The device of claim 14, wherein the activator comprises a bracket having a biasing surface and the moveable support comprises a follower that follows the biasing surface responsive to movement of the elevator car door near the closed position.

16. The device of claim 15, wherein the biasing surface comprises a plurality of inclined surfaces and the follower comprises a roller that is received between the inclined surfaces.

17. The device of claim 15, comprising a biasing member that biases the moveable support into the position corresponding to the second relative orientation and wherein the activator is operative to move the moveable support against a bias of the biasing member.

* * * * *